US007040044B2

(12) United States Patent
Brickner et al.

(10) Patent No.: US 7,040,044 B2
(45) Date of Patent: May 9, 2006

(54) METHOD OF MODULATING A BOOM ASSEMBLY TO PERFORM IN A LINEAR MANNER

(75) Inventors: Chad T. Brickner, Aurora, IL (US); C. Erik Bright, Raleigh, NC (US); Clayton L. Padgett, Raleigh, NC (US); W. Chris Swick, Raleigh, NC (US)

(73) Assignee: Caterpillar S.A.R.L., Geneva (CH)

( * ) Notice: Subject to any disclaimer, the term of this patent is extended or adjusted under 35 U.S.C. 154(b) by 119 days.

(21) Appl. No.: 10/736,396

(22) Filed: Dec. 15, 2003

(65) Prior Publication Data

US 2005/0138850 A1 Jun. 30, 2005

(51) Int. Cl.
*E02F 5/02* (2006.01)

(52) U.S. Cl. ..... 37/348; 37/414

(58) Field of Classification Search ..... 37/348, 37/414; 172/2, 11; 701/29, 30, 33, 35, 50
See application file for complete search history.

(56) References Cited

U.S. PATENT DOCUMENTS

| | | | | |
|---|---|---|---|---|
| 4,324,525 | A | 4/1982 | Lane et al. | |
| 4,332,517 | A | 6/1982 | Igarashi et al. | |
| 4,805,086 | A * | 2/1989 | Nielsen et al. | 700/59 |
| 4,844,685 | A | 7/1989 | Sagaser | |
| 4,866,641 | A * | 9/1989 | Nielsen et al. | 700/302 |
| 4,923,362 | A | 5/1990 | Fryk | |
| 4,942,737 | A | 7/1990 | Tatsumi | |
| 4,945,221 | A * | 7/1990 | Nielsen et al. | 250/203.1 |
| 4,964,779 | A | 10/1990 | Sagaser | |
| 5,307,631 | A | 5/1994 | Tatsumi et al. | |
| 5,832,729 | A | 11/1998 | Reid et al. | |
| 5,953,838 | A * | 9/1999 | Steenwyk | 37/348 |
| 6,493,616 | B1 * | 12/2002 | Rossow et al. | 701/29 |

* cited by examiner

*Primary Examiner*—Meredith Petravick

(57) ABSTRACT

A method of modulating a boom assembly to perform in a linear manner. The boom assembly includes a boom and a stick. The method comprising the steps of sending at least one lever signal to a control device indicative of operator desired direction and desired velocity of the boom and the stick, calibrating the lever signals to provide a boom command signal and a stick command signal, applying an algorithm-to-the boom command signal and the stick command signal, which the algorithm uses command signal mapping, and providing a modulating factor to the control device as a result of the algorithm.

10 Claims, 2 Drawing Sheets

METHOD OF MODULATING A BOOM ASSEMBLY TO PERFORM IN A LINEAR MANNER

TECHNICAL FIELD

This invention relates to the field of excavating work machines, and, more particularly, to a system for modulating a boom assembly for linear excavation.

BACKGROUND

Work machines that have boom assemblies serve a variety of functions, such as digging ditches, grading surfaces, and laying pipe. In order to carry out these functions, it is advantageous for the boom assembly to extend and retracted in such a manner that the work implement is kept on a linear path during the function. An operator controls the movement of the boom assembly by moving control levers or joysticks. Hydraulic actuators, connected to the boom assembly, receive the operator commands and move the boom assembly accordingly.

When grading a surface, the operator extends the boom assembly out and places the tip of the work implement into the material at an appropriate depth and angle. In order to create the linear surface, the operator must raise the boom and draw the stick in at a coordinated rate, such that the work implement follows a linear path. This takes high operator skill to coordinate the movement of the boom and stick and remove the appropriate amount of material.

Some manufacturers have tried to anticipate such a scenario and have means to coordinate the movement of the boom assembly. One known control device is found in U.S. Pat. No. 4,332,517, issued to Michiaki Igarashi et al. on Jun. 1, 1982. Igarashi discloses a control device whereupon one cylinder is manually controlled and the operation of the remaining cylinders are calculated using angle detectors provided on the boom, bucket, and arm cylinders.

The present invention is directed to overcoming one or more of the problems set forth above.

SUMMARY OF THE INVENTION

A method of modulating a boom assembly to perform in a linear manner is disclosed. The boom assembly includes a boom and a stick. The method comprising the steps of sending at least one lever signal to a control device indicative of operator desired direction and desired velocity of the boom and the stick, calibrating the lever signals to provide a boom command signal and a stick command signal, applying an algorithm to the boom command signal and the stick command signal, which the algorithm uses command signal mapping, and providing a modulating factor to the control device as a result of the algorithm.

A method of using a work machine to grade a surface is disclosed. The work machine having a boom, a stick, and a work implement coupled to the stick, each of the boom and stick is controllable by at least one lever. The method includes the steps of activating at least one lever to produce a command signal comprising at least one of a stick command signal and a boom command signal, communicating the command signal to a control device, and using the control device to modulate the command signal in accordance with a command signal mapping such that said work implement travels in a linear path.

DETAILED DESCRIPTION

Figure 1:
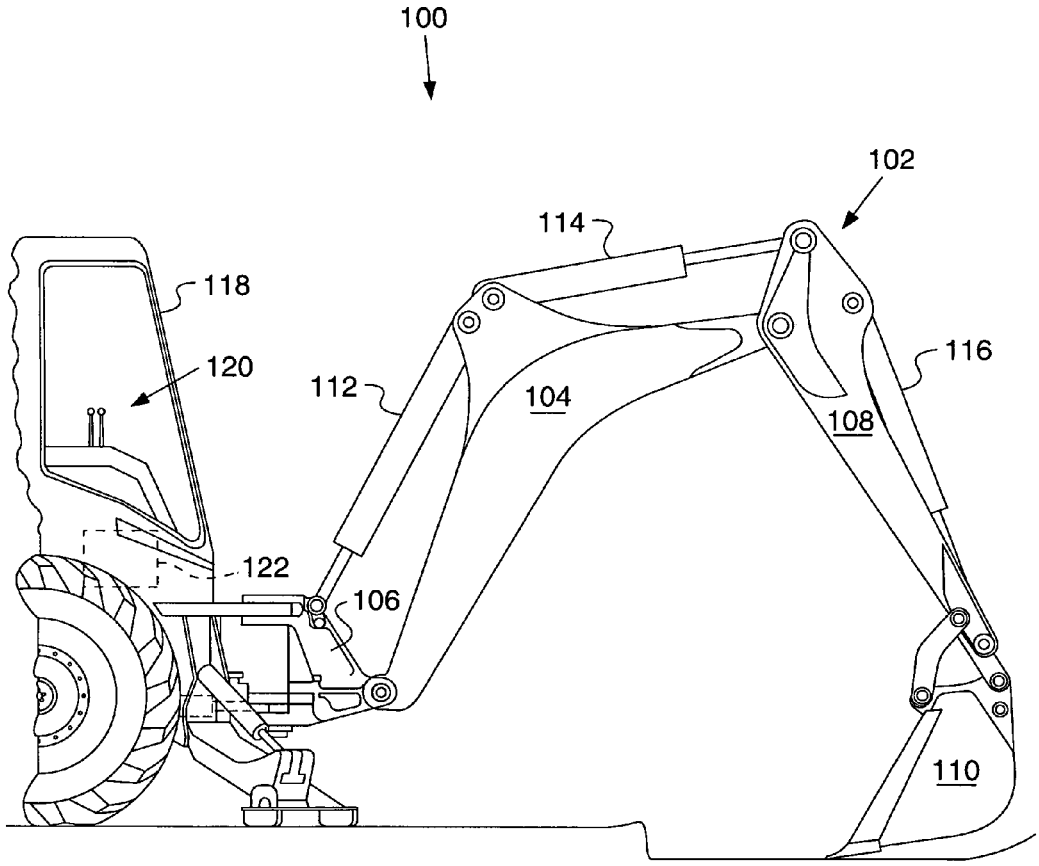
FIG. 1 is a drawing of an embodiment of a work machine.

FIG. 1 depicts a work machine 100 being attached with a boom assembly 102. The boom assembly 102 comprises a boom 104 pivotally connected to a boom support bracket 106 of the work machine 100, a stick 108 pivotally connected to the boom 104, and a work implement 110 pivotally connected to the stick 108. A boom actuator 112, such as a hydraulic cylinder, having one end connected to the boom 104 and the other end connected to the boom support bracket 106, rotates the boom 104 relative to the work machine 100 about a horizontal axis. A stick actuator 114, such as a hydraulic cylinder, having one end connected to the boom 104 and the other end connected to the stick 108, rotates the stick 108 relative to the boom 104 about a horizontal axis. A work implement actuator 116, such as a hydraulic cylinder, having one end connected to the stick 108 and the other end connected to the work implement 110, rotates the work implement 110 relative to the stick 108 about a horizontal axis.

An operator's cab 118, being positioned to view the boom assembly 102, includes a plurality of levers 120 for commanding the boom 104, stick 108, and work implement 110. The plurality of levers 120 are connected to a control device 122 within the work machine 100. The control device 122, such as a programmable electronic control module (ECM), is capable of sending command signals to control the respective boom, stick, and work implement actuators 112, 114, and 116, upon operator commands. The plurality of levers 120 are operator controlled and capable of sending lever signals to the control device 122, indicative of the position of the plurality of levers 120. The control device 122 applies a pre-determined calibration factor to the lever signal and converts the lever signal to a command signal. For exemplary purposes, the calibrated command signals for the boom 104, stick 108, and work implement 110 would have a range of −1000 to +1000, respectively, depending on the operator desired direction and desired velocity of the rotating boom 104, stick 108, and work implement 110. The −1000 would represent a full command signal to rotating in one of the clockwise or counter-clockwise direction. The +1000 would represent a full command signal to rotate in the opposing direction of the −1000. If the plurality of levers 120 is in the neutral position, 0 would represent the command signal.

Figure 2:
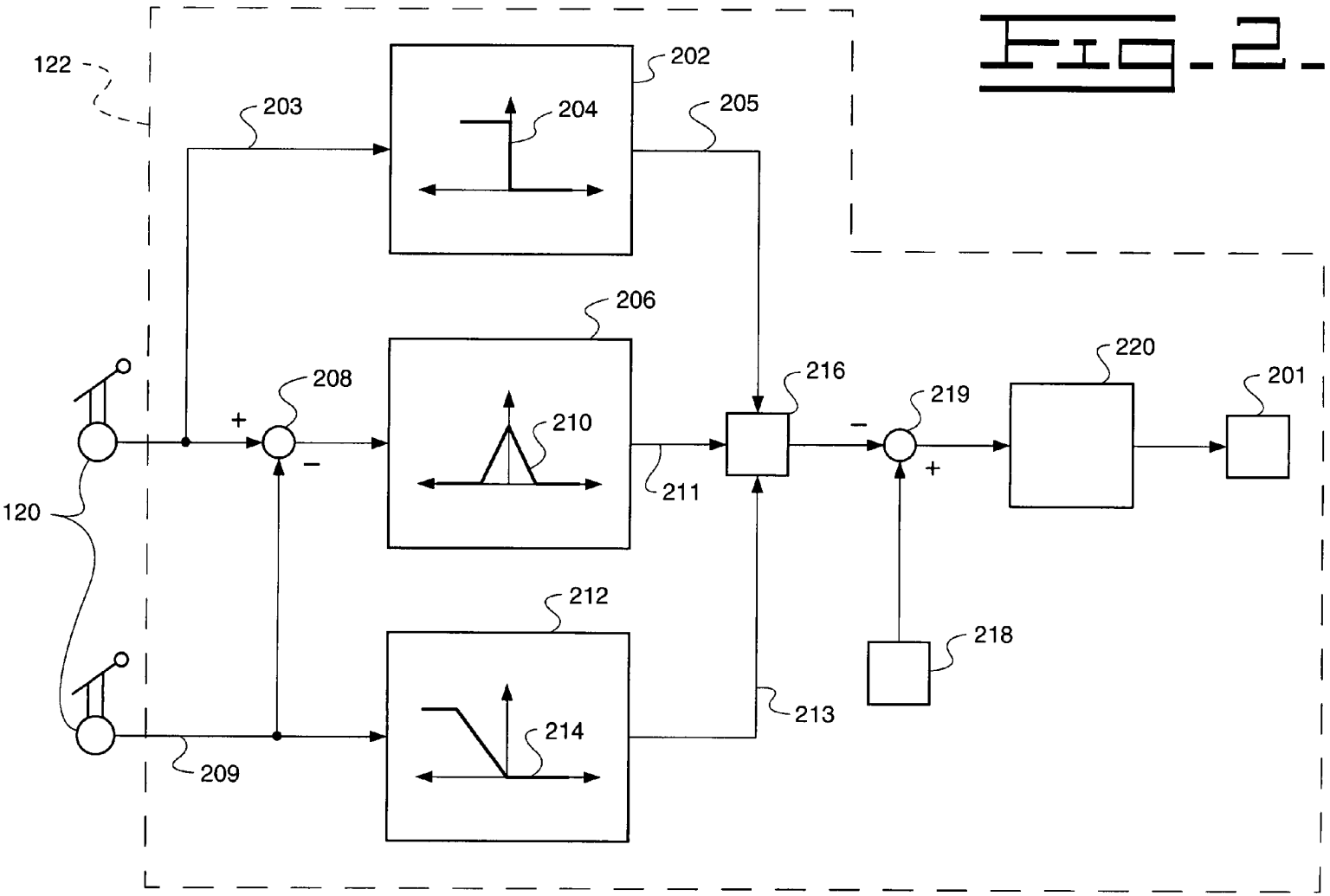
FIG. 2 is a diagrammatic view of an embodiment of an algorithm.

In FIG. 2, the control device 122 executes an algorithm in a continual manner capable of providing a modulating factor 201 to the command signal for controlling the boom 104, as a result of command signal mapping. For example, an operator gives full commands for the boom 104 and stick 108 represented by calibrated command signals of −1000 for the boom and −1000 for the stick. The algorithm maps the command signals for the boom 104 and stick 108 and provides the modulating factor 201 that changes the command signal to the boom to −500. The details of the algorithm and calculations are disclosed hereinafter.

A boom map 202 receives a boom command signal 203 from the control device 122, indicative of the lever signal from the plurality of levers 120. The boom map 202 provides a boom map output constant 205 that is indicative of the boom command signal 203. For exemplary purposes, the boom map 202 includes a pre-defined map 204 on an X and Y axis. The X axis represents the boom command signal 203, with a scale of −1000 to +1000, indicative of the maximum and minimum values of the boom command signal 203, and the Y axis represents the boom map output constant 205 with a scale of 0 to 1, indicative of the maximum and minimum boom map output constant 205 values. The boom command signal 203 of less than 0 would provide the boom map output constant 205 of 1, and the boom command signal 203 equal to or greater than 0 would provide the boom map output constant 205 of 0.

A subtraction factor map 206 receives a calculated signal 208 that is indicative of calculating the boom and stick command signals 203,209 from the control device 122. The subtraction factor map 206 provides a subtraction factor map output constant 211 that is indicative of the calculated signal 208. For exemplary purposes, the calculated signal 208 is a result of adding the boom and stick command signals 203, 209. The subtraction factor map 206 includes a pre-defined map 210 on an X and Y axis. The X axis represents the calculated signal 208, with a scale of −2000 to +2000, indicative of the calculated signal maximum and minimum values, and the Y axis represents the subtraction factor map output constant 211 with a scale of 0 to 0.5, indicative of the subtraction factor map output constant 211 maximum and minimum values. The calculated signal 208 between 0 and −1000 would provide a proportional subtraction factor map output constant 211 of 0.5 to 0, respectively. The calculated signal 208 between 0 and +1000 would provide a proportional subtraction factor map output constant 211 of 0.5 to 0, respectively. The calculated signal 208 less than −1000 and greater than +1000 would provide a subtraction factor map output constant 211 of 0.

A stick map 212 receives the stick command signal 209 from the control device 122 that is indicative of the lever signal from the plurality of levers 120. The stick map 212 provides a stick map output constant 213 that is indicative of the stick command signal 209. For exemplary purposes, the stick map 212 includes a pre-defined map 214 on an X and Y axis. The X axis represents the stick command signal 209, with a scale of −1000 to +1000, indicative of the stick command signal 209 maximum and minimum values, and the Y axis represents the stick map output constant 213 with a scale of 0 to 1, indicative of the stick map output constant 211 maximum and minimum values. The stick command signal 209 between −700 and −1000 would provide the stick map output constant 213 of 1. The stick command signal 209 between −700 and 0 would provide the proportional stick map output constant 213 of 1 to 0, respectively. The stick command signal 209 of greater than 0 would provide the stick map output constant 213 of 0.

Calculating the boom, subtraction factor, and stick output constants 205, 211, and 213 provides a final subtraction factor 216. For example, the boom, subtraction factor, and stick output constants 205, 211, and 213 are multiplied together to produce the final subtraction factor 216. The range of the final subtraction factor would be between 0 and 0.5, indicative of the maximum and minimum values of the multiplication of the boom, subtraction factor and stick output constant 205, 211, and 213.

Calculating the final subtraction factor 216 and a full boom constant 218 provides a pre-dampened modulating factor 219. For example, the final subtraction factor 216, with a range of 0 to 0.5 is subtracted from the full boom constant 218 of 1, indicative of a constant given to the maximum boom command signal 203, to provide a pre-dampened modulating factor 219 of 0.5.

The pre-dampened modulating factor 219 then passes through a rate limit control 220, which is provided to control the rate at which the modulating factor 201 can increase or decrease with respect to time, to produce smooth transitions. For example, the rate limit control 220 would allow a change of modulating factor (MF) 201 of the magnitude of ΔMF/1 s.

The modulating factor 201 is then provided to the control device 122 for modulating the boom command signal 203. For example, the modulating factor 201 of 0.5 is multiplied by the boom command signal 203 of −1000. As a result, a percentage of the boom command signal 203 of −500 is sent to control the boom 104.

INDUSTRIAL APPLICABILITY

When the operator is performing a linear function, the plurality of levers 120 are positioned to produce the desired direction and velocity of the boom 104, stick 108, and work implement 110. The plurality of levers 120 send lever signals to the control device 122 where a calibration factor is applied to provide boom and stick command signals 203, 209. The boom and stick command signals 203, 209 are sent by the control device 122 to the control the respective boom 104 and stick 108, and rotate them respective of one another.

The control device 122 executes the algorithm continually to provide a modulating factor 201 to the boom command signal 203 that is indicative of command signal mapping. Boom and stick command signals 203, 209 are mapped using boom, subtraction factor, and stick pre-defined maps 204, 210, and 214, to produce the subtraction factor 216. Subtracting the subtraction factor 216 from the full boom constant 218 provides the pre-dampened modulating factor 219. The rate limit control 220 applied to the pre-dampened modulating factor 219 provides a smooth transition in instantaneous of the modulating factor 201. The modulating factor 201 is provided to the control device 122 for modulating the boom command signal 203. The modulated boom command signal controls the boom rotation and allows coordination between the boom and stick to allow for linear movement of the work implement.

What is claimed is:

1. A method of modulating a boom assembly to perform in a desired manner, wherein said boom assembly includes a boom and a stick, comprising the steps of:

receiving a plurality of lever signals by a control device indicative of operator desired direction and desired velocity of said boom and said stick;

calibrating said plurality of lever signals to provide a boom command signal and a stick command signal;

applying an algorithm to said boom command signal and said stick command signal, wherein said algorithm uses command signal mapping; and providing a modulating factor to said boom as a result of said algorithm, said modulating factor being a function of said boom command signal, said stick command signal and a subtraction factor, said subtraction factor being a function of said plurality of lever signals.

2. The method as set forth in claim 1, further including the step of adding said stick command signal to said boom command signal to provide a calculated signal.

3. The method as set forth in claim 2, wherein said command signal mapping includes:

mapping said boom command signal to provide a boom map output constant;

mapping said stick command signal to provide a stick map output constant; and mapping said calculated signal to provide a subtraction factor map output constant.

4. The method as set forth in claim 3, further including the step of multiplying said boom map output constant, said stick map output constant, and said subtraction factor map output constant to provide a final subtraction factor.

5. The method as set forth in claim 4, further including the step of subtracting said final subtraction factor from a full boom actuator signal to provide a pre-dampened modulating factor.

6. The method as set forth in claim 1, wherein said algorithm includes applying a rate limit control to control the rate at which said modulating factor could increase or decrease with respect to time.

7. The method as set forth in claim 1, further including the step of applying said modulating factor to said boom command signal to modulate said boom movement.

8. A method of using a work machine, the work machine having a boom, a stick, and a work implement coupled to said stick, each of said boom and stick is controllable by at least one lever, comprising the steps of:

activating at least one lever for each of said boom and said stick to produce a plurality of command signals comprising at least a stick command signal and a boom command signal indicative of operator desired direction and desired velocity of said boom and said stick;

communicating said plurality of command signals to a control device;

using said control device to determine a modulating factor, said modulating factor being a function of said boom command signal, said stick command signal and a subtraction factor, said subtraction factor being a function of said plurality of command signals; and using said control device to modulate one of said plurality of command signals in accordance with said modulating factor such that said work implement travels along a desired path.

9. The method as set forth in claim 8, wherein the step of using said control device includes causing said work implement to move along a linear path.

10. The method as set forth in claim 8, wherein the step of using said control device includes applying said modulating factor to said boom command signal to modulate said boom movement.

* * * * *